US006642831B2

(12) United States Patent
Hasegawa

(10) Patent No.: US 6,642,831 B2
(45) Date of Patent: Nov. 4, 2003

(54) NONRECIPROCAL CIRCUIT DEVICE AND COMMUNICATION DEVICE USING SAME

(75) Inventor: Takashi Hasegawa, Nagaokakyo (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 411 days.

(21) Appl. No.: 09/765,140

(22) Filed: Jan. 18, 2001

(65) Prior Publication Data

US 2001/0020883 A1 Sep. 13, 2001

(30) Foreign Application Priority Data

Jan. 19, 2000 (JP) ..... 2000-009837

(51) Int. Cl.[7] ..... H01F 5/00
(52) U.S. Cl. ..... 336/200; 333/1.1
(58) Field of Search ..... 336/83, 200, 232; 333/1.1, 24.1–24.3

(56) References Cited

U.S. PATENT DOCUMENTS 6,366,178 B1 * 4/2002 Makino et al. ..... 333/1.1
6,417,741 B2 * 7/2002 Jodo ..... 333/24.2
6,420,941 B2 * 7/2002 Okada et al. ..... 333/1.1

FOREIGN PATENT DOCUMENTS

| | | | |
|---|---|---|---|
| DE | 2917124 | A1 | 11/1980 |
| EP | 0 903 801 | A2 | 3/1999 |
| JP | 39-019502 | | 9/1964 |
| JP | 7-307603 | A | 11/1995 |
| JP | 8-008613 | A | 1/1996 |
| JP | 1106842 | A1 | 3/1999 |
| JP | 11-097908 | A | 4/1999 |

* cited by examiner

*Primary Examiner*—Tuyen T. Nguyen
(74) *Attorney, Agent, or Firm*—Keating & Bennett, LLP

(57) ABSTRACT

A nonreciprocal circuit device is provided which has an improved reflection characteristic of the port of the center conductor which is disposed parallel with one side of a magnetic body. In this nonreciprocal circuit device, a magnetic assembly is formed by disposing three center conductors on a magnetic body having a rectangular parallelepiped planar shape. The conductor width of one center conductor which is disposed parallel with one side of the magnetic body is made wider than that of each of the two other center conductors.

5 Claims, 6 Drawing Sheets

NONRECIPROCAL CIRCUIT DEVICE AND COMMUNICATION DEVICE USING SAME

BACKGROUND OF THE INVENTION

1. Field of the Invention

The present invention relates to a nonreciprocal circuit device such as an isolator or a circulator used in a high-frequency band such as the microwave band, and to a communication device using the same.

2. Description of the Related Art

In recent years, with mobile communication devices speeding toward miniaturization, a further reduction in the size of nonreciprocal circuit devices used in these devices is strongly required. In order to realize this size-reduction, Japanese Unexamined Patent Application Publication No. 11-97908 has disclosed a nonreciprocal circuit device using a magnetic body having a rectangular parallelepiped shape. When using such a magnetic body having a rectangular parallelepiped shape, one center conductor is disposed parallel with one side of the magnetic body, the two other center conductors are disposed so as to tilt toward each side, and all center conductors are arranged so as to intersect one another at an angle of substantially 120 degrees, in a state of being electrically insulated from one another. Herein, the conductor widths and the inter-conductor spacings of these center conductors used are each set to be the same.

Typically, the impedance of an input/output portion in the circuit where these nonreciprocal circuit devices are used has a predetermine value (usually 50 Ω), and the impedance at each port in the nonreciprocal circuit device (hereinafter, referred to as a "port impedance") is also set to be a predetermined value.

The three center conductors which are disposed on the rectangular-parallelepiped shaped magnetic body so as to tilt toward each side of the magnetic body at an angle of 120 degrees, form a rotationally asymmetric configuration. Hence, when the conductor widths and the inter-conductor spacings of the center conductors are each made to be the same, the port impedance of the center conductor which is parallel with one side of the magnetic body becomes higher than that of each of the two other central conductors. For example, in the above-described conventional nonreciprocal circuit device, when the port impedance of the two center conductors which is disposed so as to tilt toward each side of the magnetic body is set to be 50 Ω, the port impedance of the conductor which is disposed parallel with one side of the magnetic body can become 80 Ω. This is, the two center conductors which is disposed so as to tilt toward each side of the magnetic body have a symmetric configuration with respect to the magnetic body, while the center conductor which is disposed parallel with one side of the magnetic body has a configuration asymmetric with respect to the two other center conductors. In the above-described conventional nonreciprocal circuit device, therefore, a problem occurs that the reflection characteristics of the port of the center conductor disposed parallel with one side of the magnetic body deteriorates.

SUMMARY OF THE INVENTION

Accordingly, it is an object of the present invention to provide a nonreciprocal circuit device which has an improved reflection characteristic of the port of the center conductor which is disposed parallel with one side of a magnetic body, and to provide a communication device using the same.

In order to achieve the above-described object, the present invention provides a nonreciprocal circuit device comprising a magnetic body having a rectangular parallelepiped shape, the magnetic body including three center conductors arranged to intersect one another at a predetermined angle, provided in an electrically insulated state from one another, and one of which is disposed substantially parallel with one side of the magnetic body. In this nonreciprocal circuit device, the conductor width of the center conductor which is disposed substantially parallel with one side of the magnetic body, is set to be wider than that of each of the two other center conductors. Furthermore, when each of these center conductors are constituted of a plurality of conductors, the inter-conductor spacing of the center conductor which is disposed parallel with one side of the magnetic body, is set to be wider than that of each of the two other center conductors.

In accordance with this construction, the port impedance of the center conductor which is disposed substantially parallel with one side of a magnetic body decreases, and thereby the reflection characteristics of this center conductor can be improved. Specifically, in the present invention, in order to bring the port impedance of the center conductor which is disposed parallel with one side of the magnetic body close to the port impedances of the two other center conductors, the conductor width or the inter-conductor spacing of the center conductor which is disposed parallel with one side of the magnetic body, is set to be wider than the conductor width or the inter-conductor spacing of each of the two other center conductors. This allows each port to achieve an appropriate impedance matching, which results in improved reflection characteristics at the port of each of the center conductors.

Preferably, each of the center conductors is constituted of two conductors. This allows insertion loss to be reduced by a simple structure.

Also, it is preferable that a terminating register be connected to any one of the center conductors to form an isolator. In this case, since the port of the center conductor which is disposed parallel with one side of the magnetic body has a port impedance more prone to deviate than the port impedances of the other center conductors, the port of this center conductor is suitable for an isolation port which can be terminated by a resistor having an arbitrary resistance value. It is, therefore, preferable to connect a terminating port to this port.

Moreover, a communication device in accordance with the present invention is achieved by providing it with a nonreciprocal circuit device having the above-described features. This allows a communication device having superior characteristics to be achieved.

The above and other objects, features, and advantages of the present invention will be clear from the following detailed description of the preferred embodiments of the invention in conjunction with the accompanying drawings.

DESCRIPTION OF THE PREFERRED EMBODIMENTS

The construction of a nonreciprocal circuit device in accordance with a first embodiment of the present invention will be described with reference to FIGS. 1 through 4.

Figure 1:
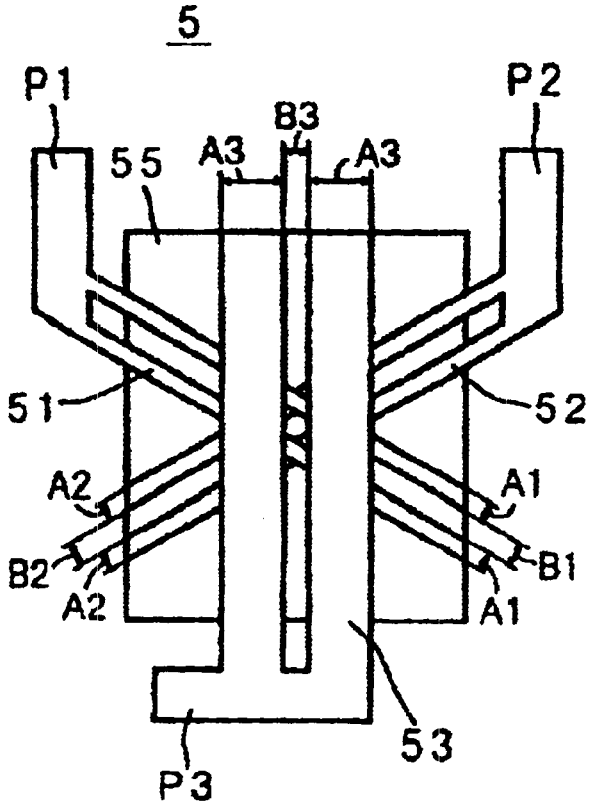
FIG. 1 is a plan view showing a magnetic assembly in accordance with a first embodiment of the present invention.
Figure 2:
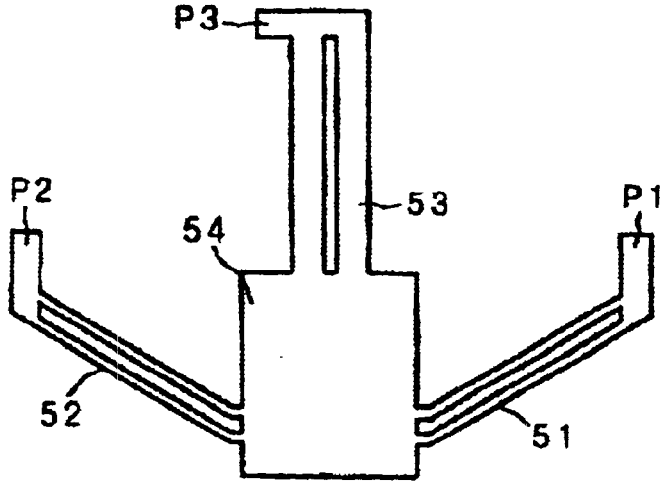
FIG. 2 is a developed view showing center conductors in accordance with the first embodiment.

The nonreciprocal circuit device in accordance with this embodiment has a magnetic assembly 5 formed as a rectangular parallelepiped plate as shown in FIG. 1, wherein three center conductors 51, 52, and 53 are disposed on a magnetic body 55 of which the top and bottom surfaces are quadrangular. The center conductors 51, 51, and 53 are formed by stamping out a plate of a metallic conductor such as copper. As shown in a developed view of FIG. 2, the center conductors 51, 51, and 53 are integrally connected at a ground portion 54 constituting a common ground terminal, and protrudes from the ground portion 54 to the outside.

The magnetic assembly 5 has a construction wherein the magnetic body 55 is placed on the common ground portion 54, and wherein all center conductors 51 through 53 are disposed on the top surface of the magnetic body 55 so as to wrap the magnetic body 55 by folding these center conductors, while forming an angle of substantially 120 degrees with respect to one another, with an insulating sheet (not shown) interposed between these center conductors. Each of the ports P1 through P3 constituting the tip portions of the respective center conductors 51 through 53 has a shape suitable for making connection with the other members, and is formed so as to protrude from the outer periphery of the magnetic body 55 to the outside. Each of the center conductors 51 through 53 is constituted of two conductors, the center conductors 51 and 52 are disposed so as to tilt with respect to each side of the magnetic body 55, and the center conductor 53 is disposed parallel to one side of the magnetic body 55.

In this embodiment, the conductor width A3 of each of the two conductors of the center conductor 53 which is disposed parallel to one side of the magnetic body 55, is made wider than the widths A1 and A2 of the two conductors of each of the other center conductors 51 and 52. That is, in this embodiment, the conductor width A3 of each of the two conductors constituting the center conductor 53 which is disposed parallel to one side of the magnetic body 55, is set to be wider than the conductor widths A1 and A2 of the respective other center conductors 51 and 52. Herein, the inter-conductor spacings B1, B2, and B3 of the respective center conductors 51, 52, and 53 have the same dimension.

Figure 3:
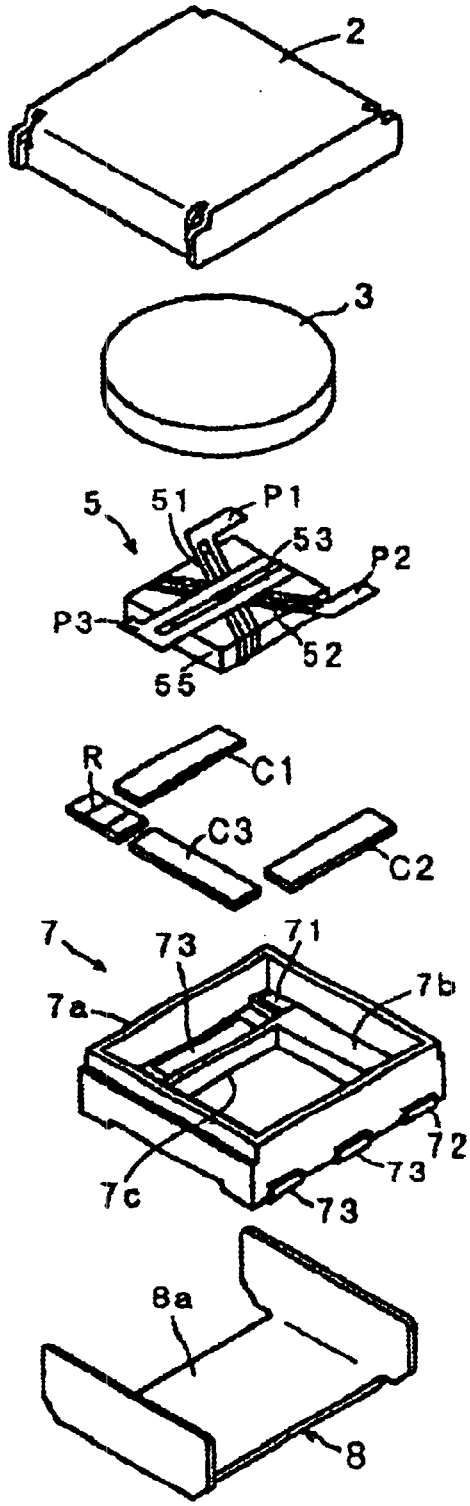
FIG. 3 is an exploded perspective view showing the overall structure of the nonreciprocal circuit device in accordance with the first embodiment.
Figure 4:
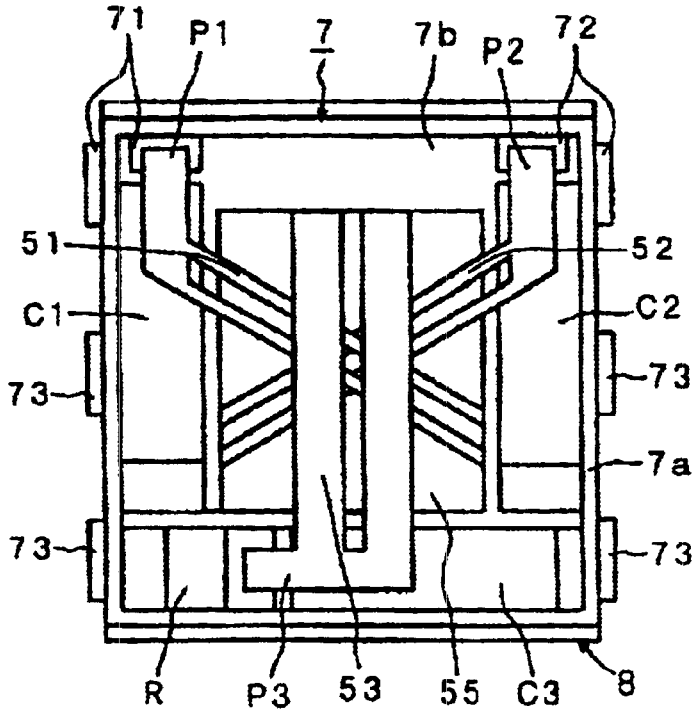
FIG. 4 is a plan view showing the nonreciprocal circuit device in accordance with the first embodiment, from which a permanent magnet and an upper yoke have been removed.

An example of a nonreciprocal circuit device which is formed using the above-described magnetic assembly 5 is shown in FIGS. 3 and 4. FIG. 3 is an exploded perspective view showing the overall structure of the nonreciprocal circuit device, and FIG. 4 is a plan view showing the nonreciprocal circuit device from which a permanent magnet and an upper yoke have been removed. This nonreciprocal circuit device is formed as an isolator by connecting a terminating resistance R to the port P3 of the center conductor 53 which is disposed parallel to one side of the magnetic body 55. Here, the direction from the port 1 to the port 2 is set to be the forward direction, and the direction from the port 2 to the port 1 is to be the reverse direction.

In this isolator, a permanent magnet 3 is disposed on the inner surface of a box shaped upper yoke 2 which is formed of a magnetic metal. A substantially U-shaped lower yoke 8 is formed of a magnetic metal. The upper yoke 2 is mounted on the upper yoke 2 to form a magnetic closed circuit. A terminal case 7 is provided on the bottom surface 8*a* in the lower yoke 8. The magnetic assembly 5, capacitors for matching C1 through C3, and a terminating resistor R are disposed in this terminal case 7. A DC magnetic field is applied to the magnetic assembly 5 by a permanent magnet 3.

The terminal case is constituted of electrical insulating material, and is constructed by integrally forming a bottom wall 7*b* with a rectangular-frame shaped side-wall 7*d*. Input/output terminals 71 and 72, and ground terminal 73 are partially embedded in resin, an insertion hole 7*c* is formed at the substantially central portion of the bottom wall 7*b*, and a plurality of recesses are provided at predetermined places on the peripheral edge of the insertion hole 7*c*.

In the recesses formed on the peripheral edge of the insertion hole 7*c*, there are provided the capacitors for matching C1 through C3, and the terminating resistor R. The magnetic assembly 5 is inserted into the insertion hole 7*c*, and the permanent magnet is disposed above the magnetic assembly 6.

The common ground portion 54 on the bottom surface of the magnetic assembly 5 is connected to the bottom surface 8*d* of the lower yoke 8. The lower-surface electrodes of the capacitors for matching C1 through C3, and the electrode of one end side of the terminating resistor R are each connected to a ground terminal 73. The ports P1 through P3 of the center conductor 51 through 53 are connected to the upper-surface electrodes of the capacitors for matching C1 through C3, respectively, and the other end side of the terminating resistor R is connected to the port P3.

Meanwhile, by using the port P3 as a third input/output port without connecting the terminating resistor R to the port P3, a circulator can be obtained.

Figure 5:
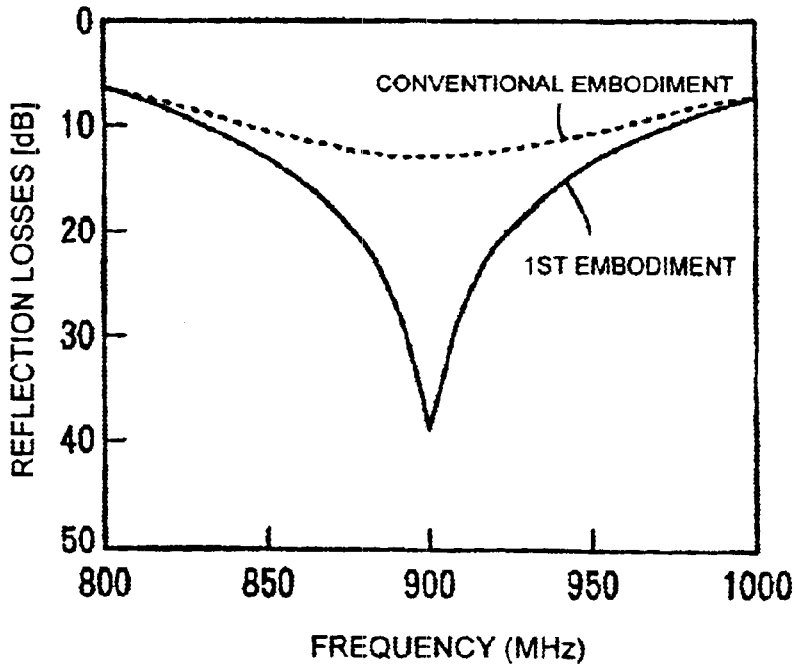
FIG. 5 is a diagram showing the reflection losses in the construction of the first embodiment and a conventional construction.

Next, the effect of construction of the first embodiment will be described with reference to FIG. 5. FIG. 5 is a diagram showing the reflection characteristics of the construction of the first embodiment (the construction shown in FIG. 1) and the conventional construction (all center conductors are formed so as to have the same conductor width and the same inter-conductor spacing), in the port of the center conductor 53 disposed parallel with one side of the magnetic body. The dimensions of the magnetic body of each of the conventional example and the first embodiment of the present invention are 3.1 mm long, 2.7 mm wide, and 0.5 mm thick. All center conductors used in the conventional example and the center conductors 51 and 52 used in the first embodiment has each a conductor width of 0.15 mm and an inter-conductor spacing of 0.2 mm, and the center conductor 53 used in the embodiment has a conductor width of 0.5 mm and an inter-conductor spacing of 0.15 mm. Saturation magnetization is set to be 0.1T, and the impedance of a measurement system is 50 Ω. In the conventional example, the port impedance corresponding to the port P3 is approximately 80 Ω at the center frequency, while the port impedance of the port P3 of the embodiment is approximately 50 Ω at the center frequency. The impedances of the other ports are each approximately 50 Ω at the center frequency.

As shown in FIG. 5, the reflection characteristics of this embodiment are, in a required frequency band, significantly superior to a conventional example. For example, at the center frequency (900 MHz), the reflection loss for the embodiment is 38.7 dB in contrast to 12.9 dB for the conventional example. That is, the embodiment exhibits a significant improvement in the reflection characteristics over the conventional example.

As described above, in this embodiment, the center conductor that has the highest port impedance when all center conductors are formed so as to have equal conductor widths as in the case of conventional examples, that is, the center conductor 53 which is disposed parallel with one side of the magnetic body, is provided with a wider conductor width A3 than the conductor widths A1 and A2 of the respective other center conductors 51 and 52. Hence, the port impedance of this center conductor 53 decreases, and thereby the reflection characteristics of the port of this center conductor 53 is improved. More specifically, the port impedance of this center conductor 53 decreases, and thereby the reflection characteristics of the port of this center conductor 53 is improved. More specifically, the port impedance of the center conductor 53 is reduced by setting the conductor width A3 wider, whereby the port impedance of the center conductor 53 is brought closer to the impedance of the circuit system, that is, takes a substantially the same impedance value as the impedance values of the other center conductors 51 and 52. This allows the port impedances of all center conductors to be set so as to match to the impedance of the circuit system. Therefore, if the magnetic assembly of the above-described embodiment is used, the insertion loss can be reduced when the port of the center conductor which is disposed parallel with one side of the magnetic body is employed as an input/output port, and the isolation characteristics can be improved when the port of the center conductor which is disposed parallel with one side of the magnetic body is employed as an isolation port.

In the above-described embodiment (FIGS. 3 and 4), the isolator is formed by connecting the terminating resistor R to the center conductor 53 which is disposed parallel with one side of the magnetic body 55, but the method of forming the isolator is not restricted to this. The isolator may instead be formed by connecting the terminating resistor R to either of the center conductors 51 and 52. It is preferable that the terminating resistor R be connected to the center conductor 53 of which the port impedance is more prone to mismatch the port impedances of the center conductors 51 and 52 as described above. Accurately matching the resistance value of the terminating resistor R to that of the port impedance value of the center conductor 53 further improves the isolation characteristics.

Figure 6:
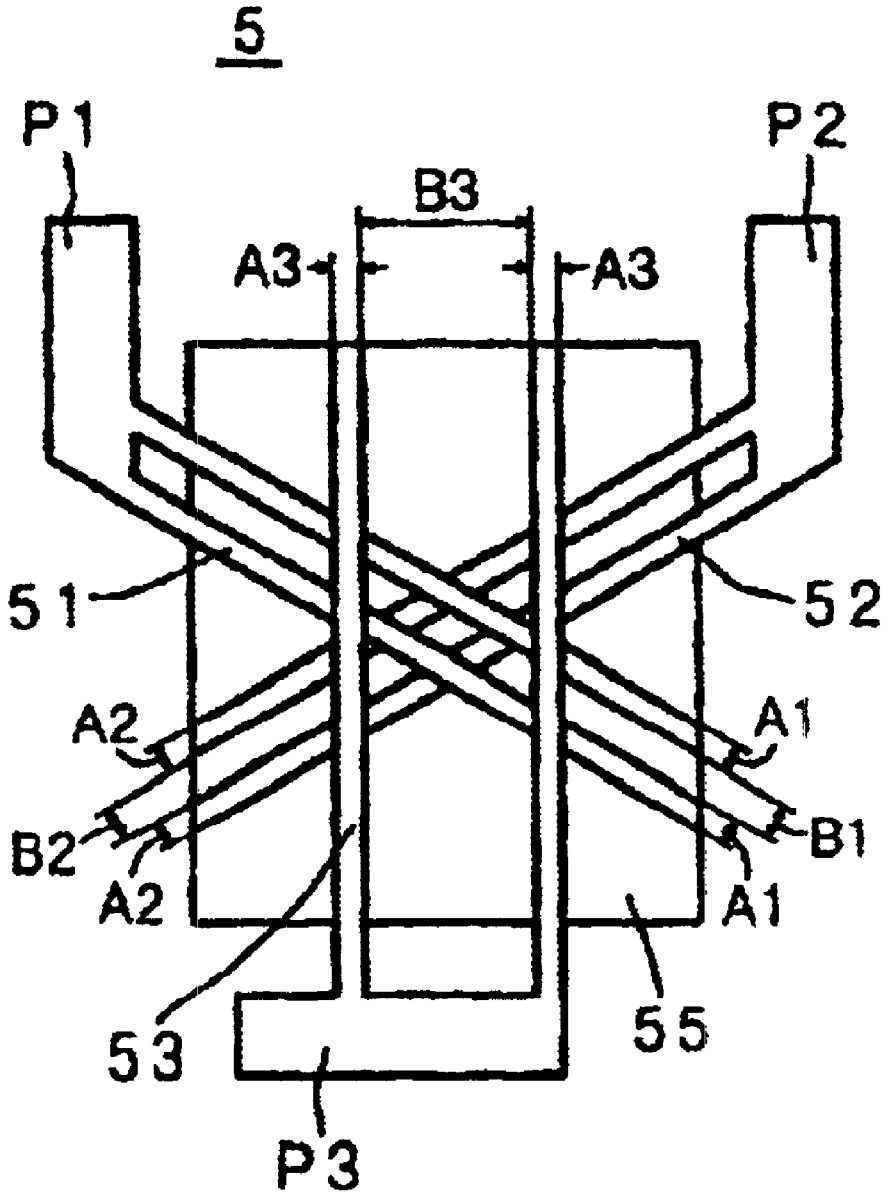
FIG. 6 is a plan view illustrating a magnetic assembly in accordance with a second embodiment of the present invention.

Next, the construction of a magnetic assembly in accordance with a second embodiment will be described with reference to FIG. 6. In the magnetic assembly 5 shown in FIG. 6, each of the center conductor 51 through 53 is constituted of two conductors, and the inter-conductor spacing B3 of the center conductor 53 which is disposed parallel with one side of the magnetic body 55, is made wider than the inter-conductor spacings B1 and B2 of the respective other center conductors 51 and 52. That is, in this embodiment, the inter-conductor spacing B3 of the two conductors constituting the center conductor 53 which is disposed parallel to one side of the magnetic body 55, is set to be wider than the inter-conductor spacings B1 and B2 of the respective other center conductors 51 and 52. Herein, the conductor widths A1, A2, and A3 of the respective center conductors 51, 52, and 53 have the same dimension.

Figure 7:
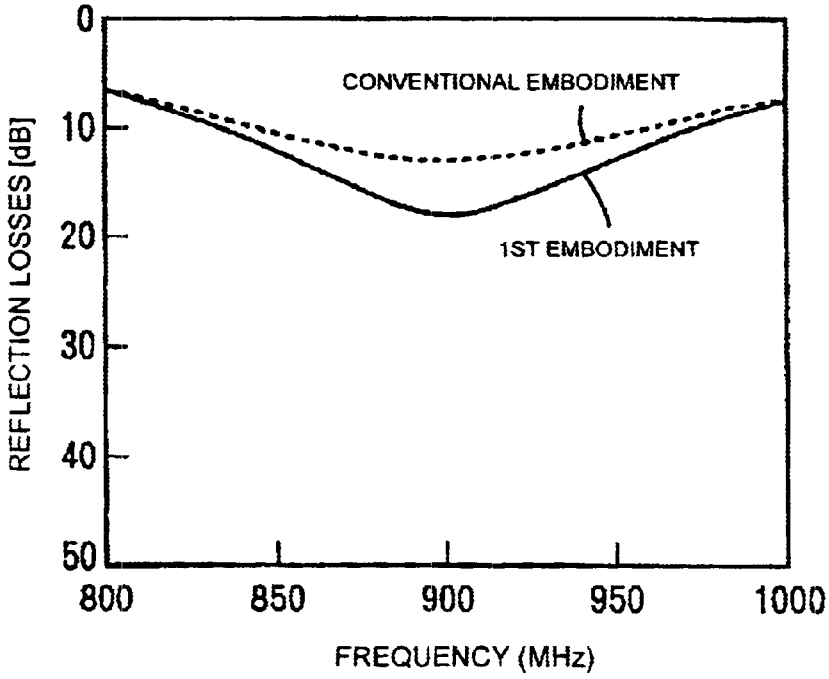
FIG. 7 is a diagram illustrating the reflection losses in the construction of the second embodiment and the conventional construction.

FIG. 7 is a diagram showing the reflection characteristics of the construction of the second embodiment (the construction shown in FIG. 6) and the conventional construction, in the port of the center conductor 53 disposed parallel with one side of the magnetic body. The center conductor 53 used in the embodiment has a conductor width of 0.15 mm and an inter-conductor spacing of 0.9 mm. Other dimensions and measuring conditions are the same as those in the above-described first embodiment. In this embodiment, the port impedance of the port P3 is approximately 65 Ω at the center frequency. The impedances of the other ports are each approximately 50 Ω at the center frequency.

As shown in FIG. 7, the reflection characteristics of this embodiment are, in a required frequency band, significantly superior to the conventional example. For example, at the center frequency (900 MHz), the reflection loss for the embodiment is 18.1 dB in contrast to 12.9 dB for the conventional example. That is, the embodiment exhibits an improvement in the reflection characteristics over the conventional example.

As described above, in this embodiment, the center conductor that has the highest port impedance when all center conductors are formed so as to have equal inter conductor spacings as in the case of conventional examples, that is, the center conductor 53 which is disposed parallel with one side of the magnetic body, is provided with a wider inter-conductor spacing B3 than the inter-conductor spacings B1 and B2 of the respective other center conductors 51 and 52. Hence, the port impedance of this center conductor 53 decreases, and thereby the reflection characteristics of the port of this center conductor 53 is improved. More specifically, the port impedance of the center conductor 53 is reduced by setting the inter-conductor spacing B3 wider, whereby the port impedance is brought closer to the impedance of the circuit system. Therefore, if the magnetic assembly of this embodiment is used, the insertion loss can be reduced when the port of the center conductor which is disposed parallel with one side of the magnetic body is employed as an input/output port, and the isolation characteristics can be improved when the port of the center conductor which is disposed parallel with one side of the magnetic body is employed as an isolation port.

Figure 8:
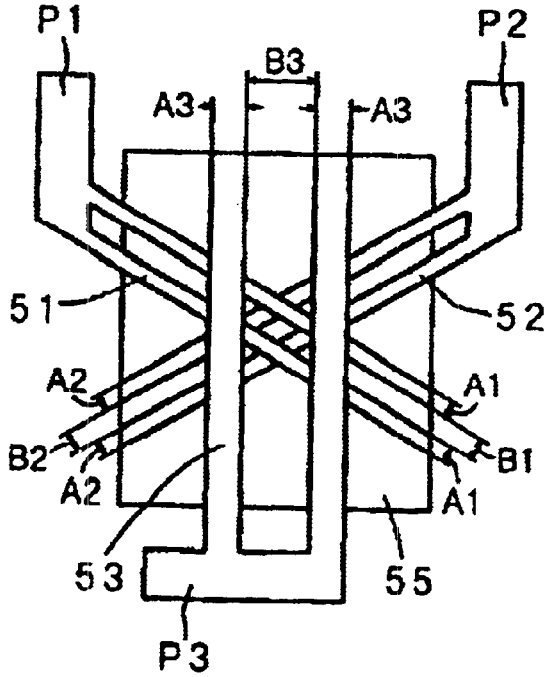
FIG. 8 is a plan view illustrating a magnetic assembly in accordance with a third embodiment of the present invention.

Next, the construction of a magnetic assembly in accordance with a third embodiment will be described with reference to FIG. 8. In the magnetic assembly 5 shown in FIG. 8, each of the center conductor 51 through 53 is constituted of two conductors, and the conductor width A3 of each of the two conductors constituting the center conductor 53 which is disposed parallel with one side of the magnetic body 55, is made wider than the conductor widths A1 and A2 of the respective other center conductors 51 and 52, and the inter-conductor spacing B3 of the center conductor 53 is made wider than the inter-conductor spacings B1 and B2 of the respective other center conductors 51 and 52. That is, in this embodiment, each of the conductor widths A3 and the inter-conductor spacing B3 of the two conductors constituting the center conductor 53 which is disposed parallel to one side of the magnetic body 55, are set to be wider than the conductor widths A1 and A2 and the inter-conductor spacings B1 and B2 of the respective other center conductors 51 and 52.

Figure 9:
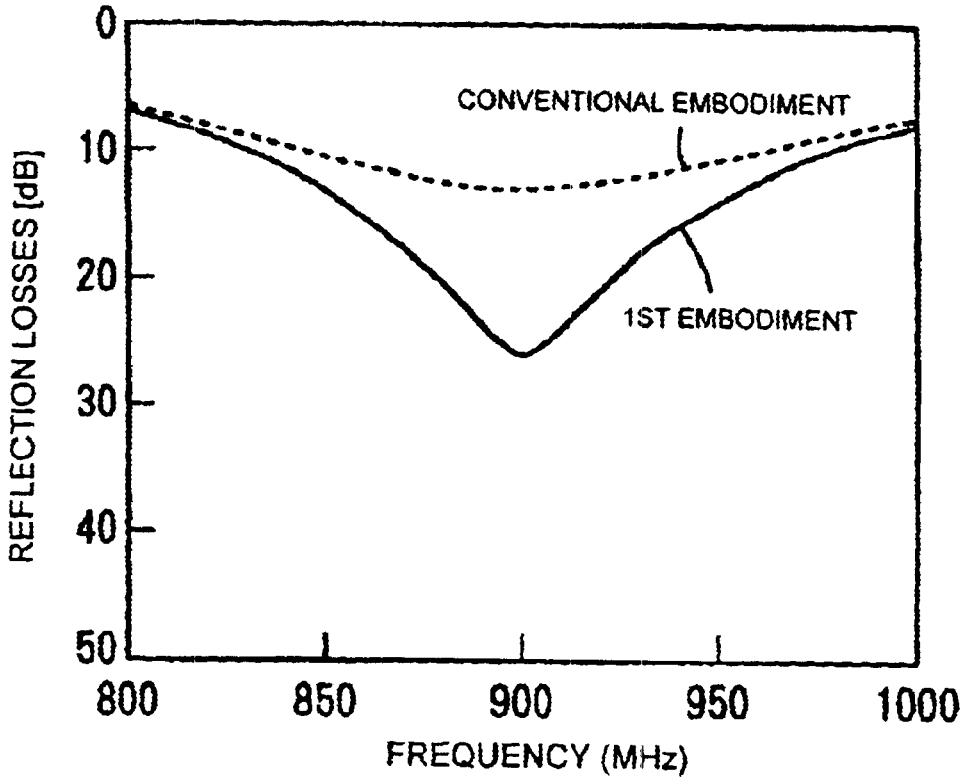
FIG. 9 is a diagram illustrating the reflection losses in the construction of the third embodiment and the conventional construction.

FIG. 9 is a diagram showing the reflection characteristics of the construction of the third embodiment (the construction shown in FIG. 8) and the conventional construction, in the port of the center conductor 53 disposed parallel with one side of the magnetic body. The center conductor 53 used in the embodiment has a conductor width of 0.3 mm and an inter-conductor spacing of 0.6 mm. Other dimensions and measuring conditions are the same as those in the above-described first embodiment. In this embodiment, the port impedance of the port P3 is approximately 55 Ω at the center frequency. The impedances of the other ports are each approximately 50 Ω at the center frequency.

As shown in FIG. 9, the reflection characteristics of this embodiment are, in a required frequency band, significantly superior to the conventional example. For example, at the center frequency (900 MHz), the reflection loss for the embodiment is 25.4 dB in contrast to 12.9 dB for the conventional example. That is, the embodiment exhibits an improvement in the reflection characteristics over the conventional example.

As described above, in this embodiment, the center conductor that has the highest port impedance when all center conductors are formed so as to have equal conductor widths and equal inter-conductor spacings as in the case of the conventional example, that is, the center conductor 53 which is disposed parallel with one side of the magnetic body, is provided with a wider conductor width A3 and a wider inter-conductor spacing B3 than the conductor widths A1 and A2 and the inter-conductor spacings B1 and B2 of the respective other center conductors 51 and 52. Hence, the port impedance of this center conductor 53 decreases, and thereby the reflection characteristics of the port of this center conductor 53 is improved. More specifically, the port impedance of the center conductor 53 is reduced by setting the conductor width A3 and the inter-conductor spacing B3 wider, whereby the port impedance is brought closer to the impedance of the circuit system. Therefore, if the magnetic assembly of this embodiment is used, the insertion loss can be reduced when the port of the center conductor which is disposed parallel with one side of the magnetic body is employed as an input/output port, and the isolation characteristics can be improved when the port of the center conductor which is disposed parallel with one side of the magnetic body is employed as an isolation port.

In the above-described embodiments, each of the center conductors 51, 52, and 53 was described as being a center conductor formed of two conductors, but the method of forming the center conductor is not restricted to this. Each of these center conductors 51, 52, and 53 may instead be formed of one conductor, or may be formed of three conductors or more.

Furthermore, in the above-described embodiments, each of the center conductors was described as having a structure wherein each of the center conductors formed of a metallic plate is folded and disposed on the magnetic body, but the structure of the center conductor is not restricted to this. The structure of each of the center conductors may instead be a structure wherein the center conductor is formed of an electrode film on the inside or the surface of a dielectric body or a magnetic body. Also, the shape of the permanent magnet 3 is not limited to a circular shape, but a polygonal shape such as a quadrangular shape in a plan view may be used.

Figure 10:
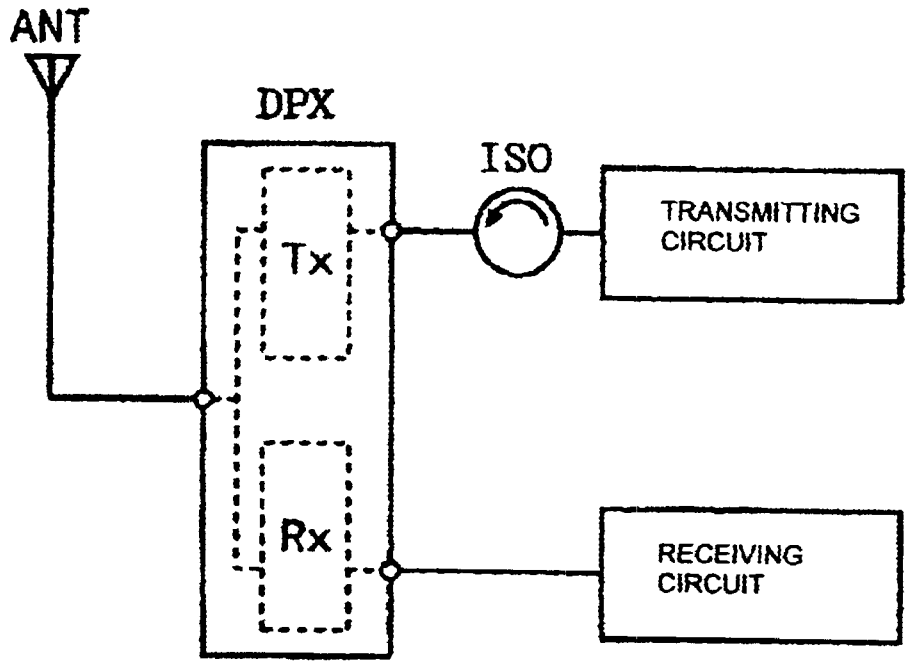
FIG. 10 is a block diagram illustrating a communication device in accordance with a fourth embodiment of the present invention.

Next, the construction of a communication device in accordance with a fourth embodiment is shown in FIG. 10. In this communication device, an antenna ANT is connected to the antenna end of a duplexer DPX comprising a transmission filter TX and a reception filter RX, an isolator ISO is connected between the input end of the transmission filter TX and a transmitting circuit, and a receiving circuit is connected to the output end of the reception filter RX. A transmitted signal from the transmitting circuit is emitted from the antenna ANT via the isolator ISO and the transmission filter TX. The received signal which is received at the antenna ANT is input to the receiving circuit through the reception filter RX.

Here, as an isolator ISO, the isolator of each of the above-described embodiments can be used. By using the nonreciprocal circuit device in accordance with the present invention, which has improved reflection characteristics, a communication device having superior characteristics can be obtained.

As evident from the above description, in accordance with the nonreciprocal circuit device of the present invention, since the conductor width and/or the inter-conductor spacing of the center conductor which is disposed parallel with one side of the magnetic body, is set to be wider than the conductor width and/or the inter-conductor spacing of each of the other center conductors, the port impedance of the center conductor which is disposed parallel with one side of the magnetic body decreases, and thereby the reflection characteristics at the port of this center conductor is improved. Therefore, the present invention allows a nonreciprocal circuit device which has low insertion loss and superior isolation characteristics to be achieved.

Furthermore, by mounting the nonreciprocal circuit device in accordance with the present invention, a communication device having superior characteristics can be realized.

While the present invention has been described with reference to what are at present considered to be the preferred embodiments, it is to be understood that various changes and modifications may be made thereto without departing from the invention in its broader aspects and therefore, it is intended that the appended claims cover all such changes and modifications as fall within the true spirit and scope of the invention.

What is claimed is:

1. A nonreciprocal circuit device comprising:

a magnetic body having a rectangular parallelepiped shape, said magnetic body including three center conductors arranged to intersect one another at a predetermined angle, provided in an electrically insulated state from one another, and one of which is disposed substantially parallel with one side of the magnetic body, wherein the conductor width of the center conductor which is disposed substantially parallel with one side of the magnetic body, is set to be wider than the conductor width of each of the two other center conductors.

2. A nonreciprocal circuit device, as claimed in claim 1, wherein:

each of said three center conductors includes two conductors.

3. A nonreciprocal circuit device, as claimed in claim 1, wherein:

a terminating resistor is connected to a port of any one of said three center conductors.

4. A nonreciprocal circuit device, as claimed in claim 3, wherein:

a terminating resistor is connected to the port of the center conductor which is disposed substantially parallel with the side of said magnetic body.

5. A communication device comprising:

a nonreciprocal circuit device as claimed in claim 1.

* * * * *